US007712422B2

(12) United States Patent
Bue

(10) Patent No.: US 7,712,422 B2
(45) Date of Patent: May 11, 2010

(54) FOLDING TABLE

(75) Inventor: Richard C. Bue, Eden Prairie, MN (US)

(73) Assignee: Sico Incorporated, Edina, MN (US)

( * ) Notice: Subject to any disclaimer, the term of this patent is extended or adjusted under 35 U.S.C. 154(b) by 244 days.

(21) Appl. No.: 11/489,256

(22) Filed: Jul. 19, 2006

(65) Prior Publication Data

US 2008/0017082 A1 Jan. 24, 2008

(51) Int. Cl.
*A47B 3/00* (2006.01)

(52) U.S. Cl. ..... 108/115

(58) Field of Classification Search ..... 108/115, 108/6–9, 1; 248/188, 122.1, 124.1, 125.7, 248/397

See application file for complete search history.

(56) References Cited

U.S. PATENT DOCUMENTS

| | | | | | |
|---|---|---|---|---|---|
| 510,858 | A | * | 12/1893 | Hastings | 108/160 |
| 1,325,130 | A | * | 12/1919 | Whitacre | 108/115 |
| 2,178,248 | A | * | 10/1939 | Bristow | 108/132 |
| 2,934,386 | A | | 4/1960 | Shore | |
| 3,028,197 | A | * | 4/1962 | Wilson | 297/124 |
| 3,437,058 | A | * | 4/1969 | Bue | 108/166 |
| 3,536,356 | A | | 10/1970 | Wilson | |
| 3,999,245 | A | | 12/1976 | Bue et al. | |
| 4,052,100 | A | | 10/1977 | Nikitits et al. | |
| 4,070,057 | A | | 1/1978 | Jones | |
| 4,089,522 | A | * | 5/1978 | Rock | 108/173 |
| 4,131,311 | A | | 12/1978 | Nikitits et al. | |
| 4,337,670 | A | | 7/1982 | Carlson | |
| 4,653,804 | A | | 3/1987 | Yoo et al. | |
| 4,700,987 | A | | 10/1987 | Sraka et al. | |
| 4,826,244 | A | | 5/1989 | Choi | |
| 4,883,314 | A | | 11/1989 | Sakong | |
| 4,885,813 | A | | 12/1989 | McNamara | |
| 5,029,938 | A | | 7/1991 | Song | |
| D330,127 | S | | 10/1992 | Song | |
| 5,660,000 | A | * | 8/1997 | MacIntyre | 52/9 |
| 5,683,135 | A | | 11/1997 | Williams | |
| 5,944,291 | A | * | 8/1999 | Kato et al. | 248/188.2 |
| 6,192,808 | B1 | * | 2/2001 | Bue | 108/115 |
| 7,066,098 | B2 | * | 6/2006 | Blasen et al. | 108/115 |

OTHER PUBLICATIONS

SICO Room Service Tables, 2 pages (Oct. 2000).
SICO Catering Tables Single-Tier and Two-Tier, 4 pages (Aug. 2004).
Installation Instructions for Stabilizer Bar and Replacement Parts List LB Table, 2 pages (Nov. 2000).

* cited by examiner

*Primary Examiner*—Janet M Wilkens
(74) *Attorney, Agent, or Firm*—Merchant & Gould PC

(57) ABSTRACT

A folding table includes a frame with a folding top mounted to the frame. A linkage mounts to the frame and to the top and facilitates movement of the top between a horizontal use position and a folded position wherein the top is substantially vertical. The linkage includes a link mounted to the frame at a first end and to the table top at a second end. A first element mounts to the underside of the top and has a slot with a straight portion and an end portion extending upward at an oblique angle to the straight portion. A follower mounts at the top of the frame and slides in the slot and resting in the end portion when the top is in the use position. The slot, follower and linkage are configured so that the table top does not require latching, but cannot be accidentally folding when force is applied to the top.

17 Claims, 6 Drawing Sheets

FOLDING TABLE

BACKGROUND OF THE INVENTION

1. Field of the Invention

The present invention relates to a table with a folding top and in particular to a table with a folding top that automatically moves into a use position wherein the tabletop cannot be accidentally folded and automatically releases by lifting the top.

2. Description of the Prior Art

In large, multi-purpose rooms that are utilized at various times as dining rooms, meeting halls, dance areas, training rooms, classrooms and for other varied activities, it is often desirable that multi-purpose furniture be used. Such furniture includes tables, chairs, benches and/or stools or table and seat combinations. Such furniture provides added utility if it folds so that it takes up less space when stored. Examples of folding tables are shown in U.S. Pat. Nos. 2,771,937 to Wilson; 3,075,809 to Wilson; 3,099,480 to Wilson; and 6,254,178 to Bue, all assigned to Sico, Inc., the Assignee of the present invention.

Folding tables that are used for quick setup and takedown have added utility if they are easily transported. Therefore, it is desirable to have folding tables mounted on casters or rollers. Moreover, the tables should nest close to one another when folded so that much less floor space is needed when the tables are not in use.

In addition to easy transport and less space required for storage, such tables should be easy and safe to operate. Such tables should have a safe, simple and reliable folding mechanism that cannot accidentally allow the table to fold from the use configuration. An issue often encountered with folding furniture is accidental folding. In particular, some folding tables may be subject to accidental folding if a heavy load is placed on an edge of the table. The folding and unfolding should provide sufficient resistance so the tabletop does not fold too quickly, yet does not offer too much resistance leading to accidentally tipping the table over when the top is urged toward a folded position.

It can be seen that a new and improved folding table is needed. Such a table should provide for safe and reliable operation with the tabletop folding between a use position and a storage position. The table should nest closely when configured for storage. Moreover, the table should have a linkage that prevents accidental folding from weight being placed on the tabletop surface in the use position. Such a table should not require a separate latch to actuate or separate latching and unlatching steps. Such a table should also provide for safe and reliable actuation when designer tops over a wide range of weights are supported. The present invention addresses these problems, as well as others associated with folding tables and their operation.

SUMMARY OF THE INVENTION

The present invention is directed to a folding table and in particular to a folding table that automatically prevents accidental folding of the table. The folding table includes a folding tabletop mounted on a linkage to a support frame. The frame generally includes a lower frame member attached to rollers or casters for easy transport of the table. The framework includes vertical members near each end of the table and a longitudinal cross member. A linkage mounts to each vertical frame structure and the tabletop is supported by the linkages and the top of the vertical frame structures.

Each linkage includes a member mounted to the underside of the tabletop and defining a slot therein. The slot extends generally horizontally and parallel to the tabletop and includes an extended straight portion. An end portion of the slot angles upward and arcs slightly upward from the straight portion at one end of the slot. The straight portion and the angled portion define a toggle point at their juncture. A follower member mounts at the top of the frame and rides in the slot. At the folded position, the follower moves to the end of the slot opposite the angled arcing portion. In the use position, the follower is in the arcing angled portion at its extremity. The arc and angle of the end portion are configured so that the follower can be moved into the straight portion of the slot only when an edge of the tabletop is lifted. The linkage also includes an arm mounted between the underside of the tabletop and the vertical frame structure. The tabletop may include designer finishes such as granite, marble or other finishes that are heavier than conventional tabletop finishes so that additional support and assistance may be needed for folding. Therefore, gas springs or other assist devices may be attached between the tabletop and the frame to assist and control folding between the use and storage positions.

In use, the tabletop is generally vertical for storage. This allows for nesting of tables so that less floor space is needed for storage. To configure the table for use, the tabletop is lifted so that the arm and lift spring are pivoted about their lower ends. The lift spring acts as a damper so that the tabletop does not drop quickly. The follower moves along the slot toward the end angled and arcing portion. When the tabletop is moved to the fully horizontal use position, the follower is at the extreme end of the angled portion. With the follower at this point, if pressure is applied to either edge of the tabletop, the geometry of the angled end portion and slight arc prevents the follower from moving back along to the straight portion of the slot. Slight jarring does not move the follower past the intersection, which acts as a toggle point. To move the tabletop from the horizontal use position to a storage position, the edge of the tabletop opposite the arcing portion is lifted slightly and moved toward the folded storage position. This action moves the slot up so that the follower is moved to the bottom edge of the slot so it can pass into the straight section of the slot. The follower moves around the intersection and toggle point and the weight of the tabletop alone can finish the folding to the storage position. The arm helps to guide the tabletop along its path between the folded position and use position and pivoting about the follower. The gas springs act as a damper so that the folding does not occur too quickly in either direction.

It can be appreciated that the geometry of the angled portion is important for proper operation. If the angle is too acute and arc radius too small, the follower does not move and the tabletop may be difficult to actuate. If the angle is too flat and the end portion too short, the follower will travel too easily and accidental folding may occur. It has been found that an angle of 25 degrees has provided superior performance results. However, angles of between 20 and 30 degrees have also been found to provide acceptable performance.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

DETAILED DESCRIPTION OF THE PREFERRED EMBODIMENT

Figure 1:
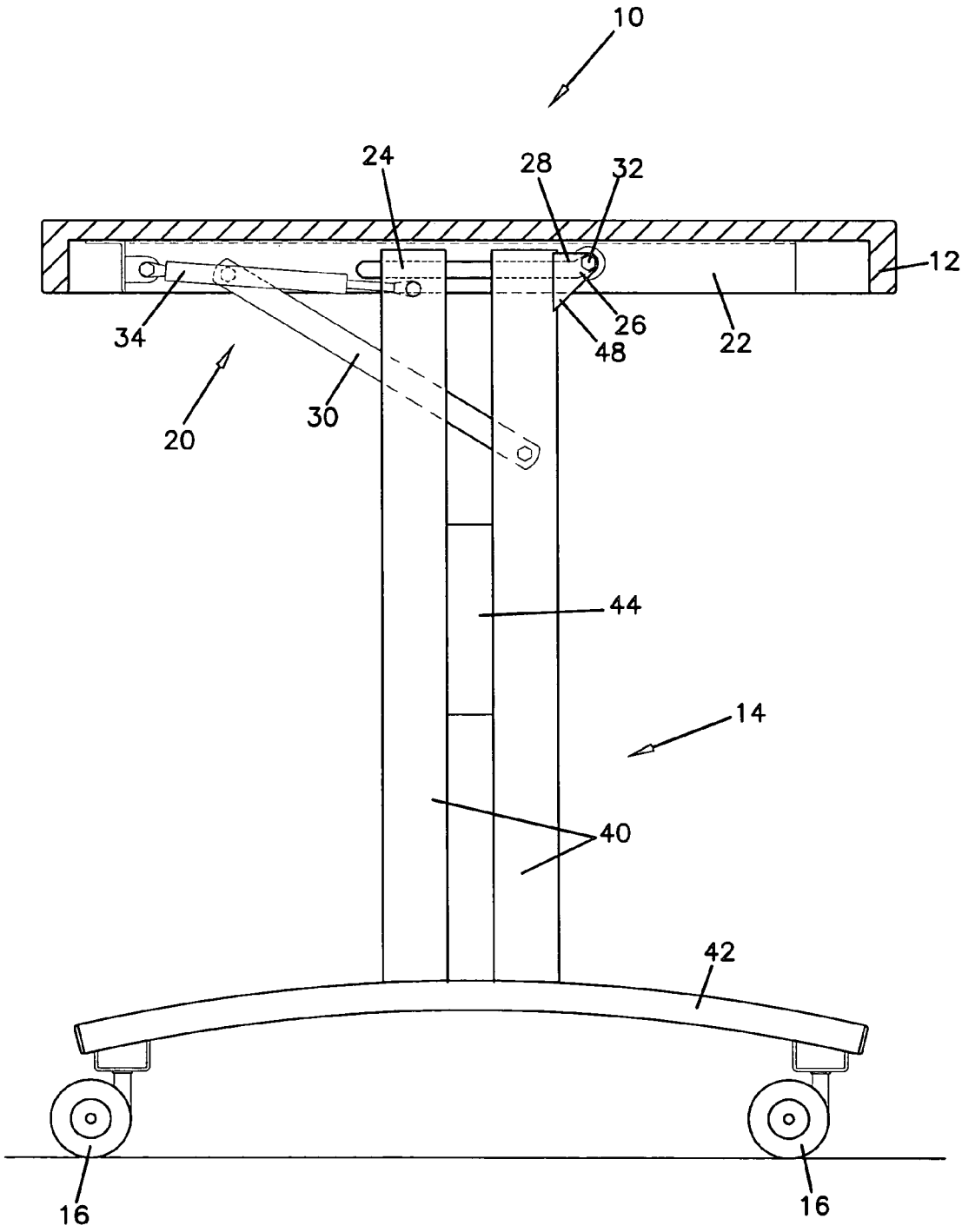
FIG. 1 is an end elevational view of a folding table in a use position according to the principles of the present invention.
Figure 2:
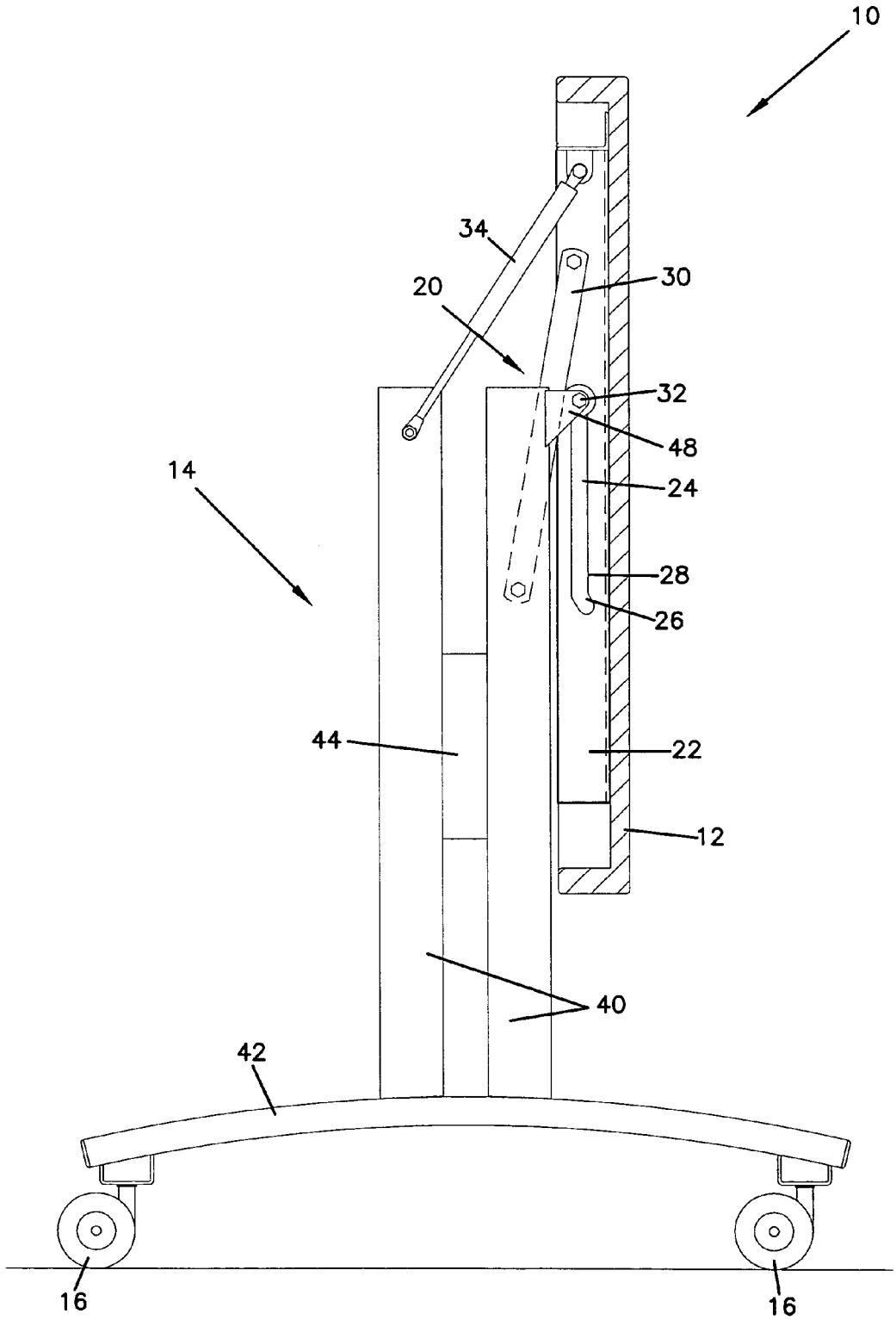
FIG. 2 is an end elevational view of the folding table shown in FIG. 1 in a folded position.
Figure 3:
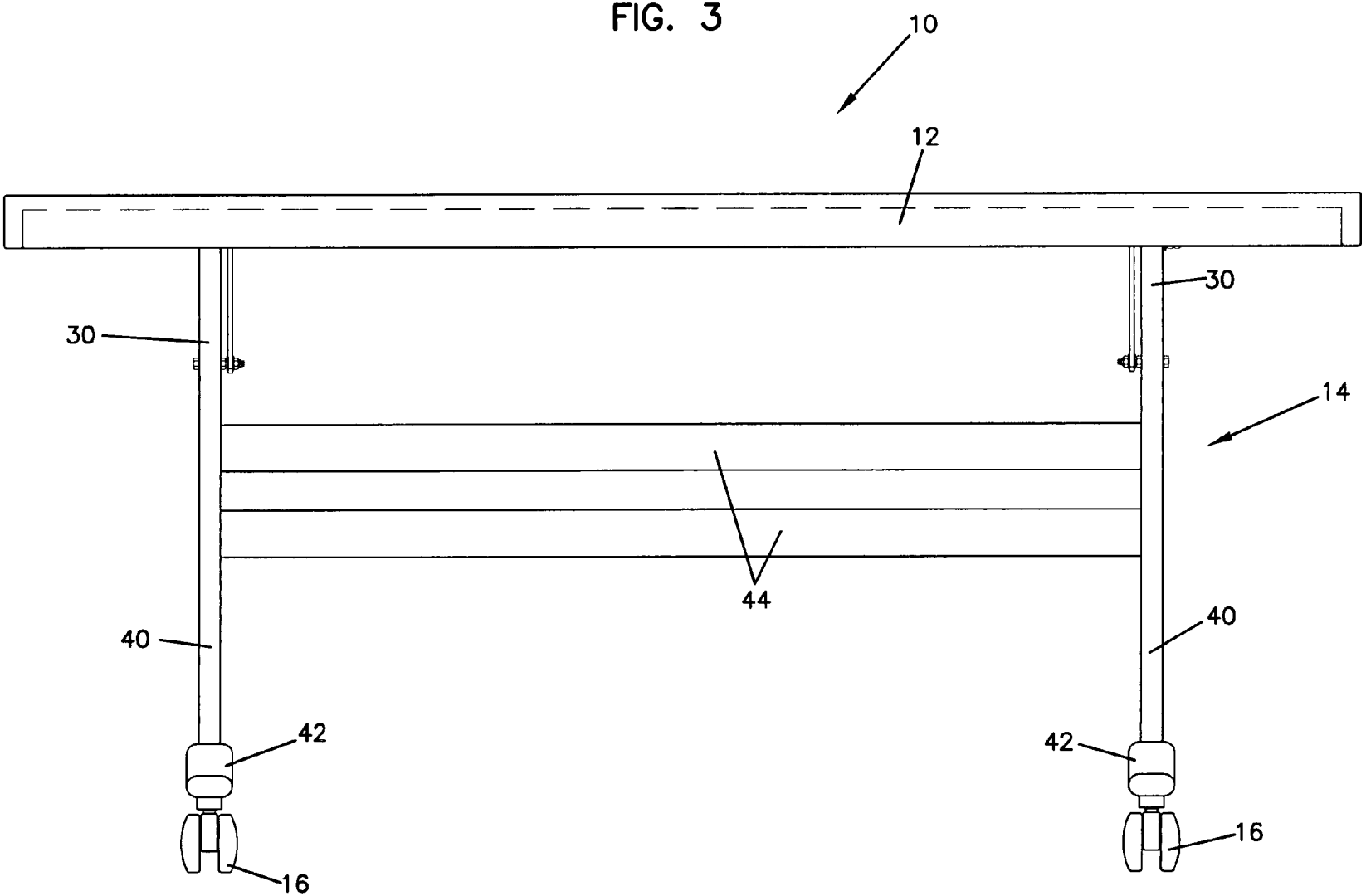
FIG. 3 is a side elevational view of the folding table shown in FIG. 1 in the use position.
Figure 4:
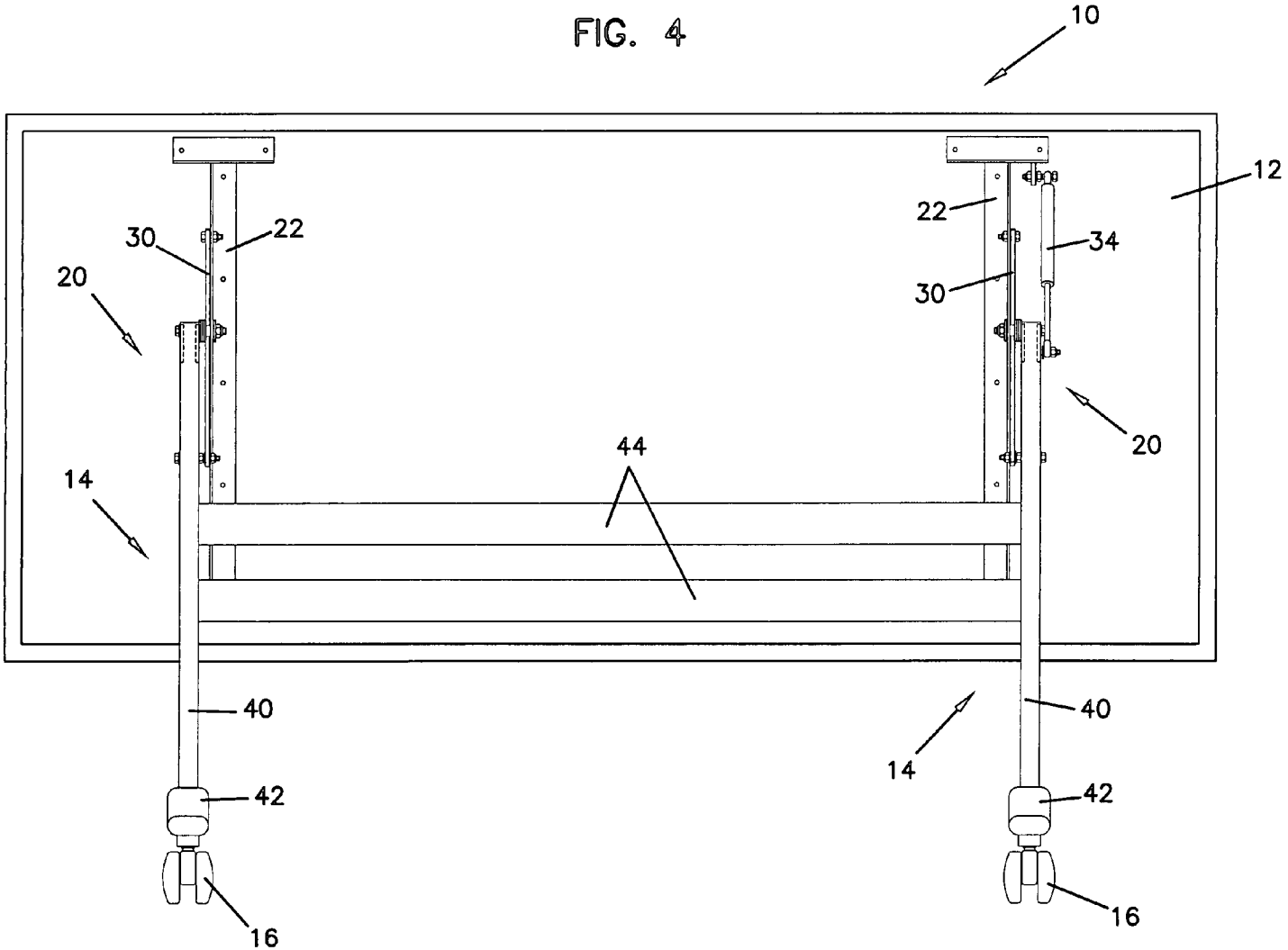
FIG. 4 is a side elevational view of the folding table shown in FIG. 1 in the folded position.

Referring to the drawings and in particular to FIGS. 1 and 2, there is shown a folding table, generally designated 10. The table 10 includes a folding tabletop 12 that folds from a use position wherein the tabletop 12 is horizontal as shown in FIGS. 1 and 3, to a folded storage position wherein the tabletop 12 is substantially vertical, as shown in FIGS. 2 and 4. The tabletop 12 typically mounts on a support frame 14 that rolls on casters 16. The casters 16 provide for easy portability. In a preferred embodiment, the casters 16 are lockable so that the table 10 can be secured at a position for use or storage. The frame 14 includes vertical upright structures 40 at opposite ends of the table. The upright structures 40 mount to an associated arcing lower frame member 42 having the casters 26 mounted thereon. The lower frame member 42 may be removably mounted to the uprights 40 for more compact shipping. Longitudinal frame members 44 extend lengthwise and connect the frame upright structures 40. It can be appreciated that the frame 14 is configured so that when the tabletop 12 is folded to a use position as shown in FIGS. 2 and 4, the lower frame members 42 slide beneath the cross members 44 and the tables 10 may be closely nested for storage with the generally vertical tabletops 12 arranged in parallel close to one another.

To facilitate folding, the table 10 includes a pair of linkages 20, one associated with each vertical frame structure 40. Each linkage 20 includes a first member 22 mounted to an underside of the tabletop 12, as shown most clearly in FIGS. 6 and 7. A longitudinal slot 24 is formed in element 22. The slot 24 has a substantially straight main portion, but includes an end portion 26 that extends upward from the main section of the slot 24 in a slightly upward arcing manner. The end portion 26 extends at an angle of approximately 25 degrees in a preferred embodiment. However, it has been found that satisfactory performance has also been achieved when the end portion 26 is at an angle of 20 degrees to 30 degrees from the main portion of the slot 24. A follower 32 mounts on a bracket 48 at the top of the vertical frame structure 40 and acts as a pivot for the tabletop 12. The follower 32 rests in the slot 24 and moves from the endmost point of the end portion 26 in the use position to the opposite end of the slot 24 in the storage position while the tabletop 12 pivots. The intersection of the main straight portion of the slot 24 with the end portion 26 forms a toggle point 28 that retains the follower 32 in the end portion. In the use position, the follower 32 is securely positioned at the extreme tip of the end portion 26.

The linkages 20 are configured so that the follower 32 cannot accidentally be moved from the use position due to the geometry of the slot 24. In order to actuate the linkage 20 and move the tabletop 12 from the use position to the storage position, it is necessary to lift the edge of the tabletop 12 opposite the end portion 26. The lifting moves the end portion of the slot 26 up and allows the follower 32 to move past the toggle point 28 along the lowered edge of the end portion 26. The tabletop 12 and the linkages 20 may then fold to the folded storage position as shown in FIGS. 2 and 4. It can be appreciated that bumping or sitting on any of the edges of the tabletop 12 does not accidentally fold the tabletop 12. The geometry of the slot end portion 26 prevents the follower 32 from being jarred or sliding beyond the toggle point 28 and prevents accidental folding.

Figure 5:
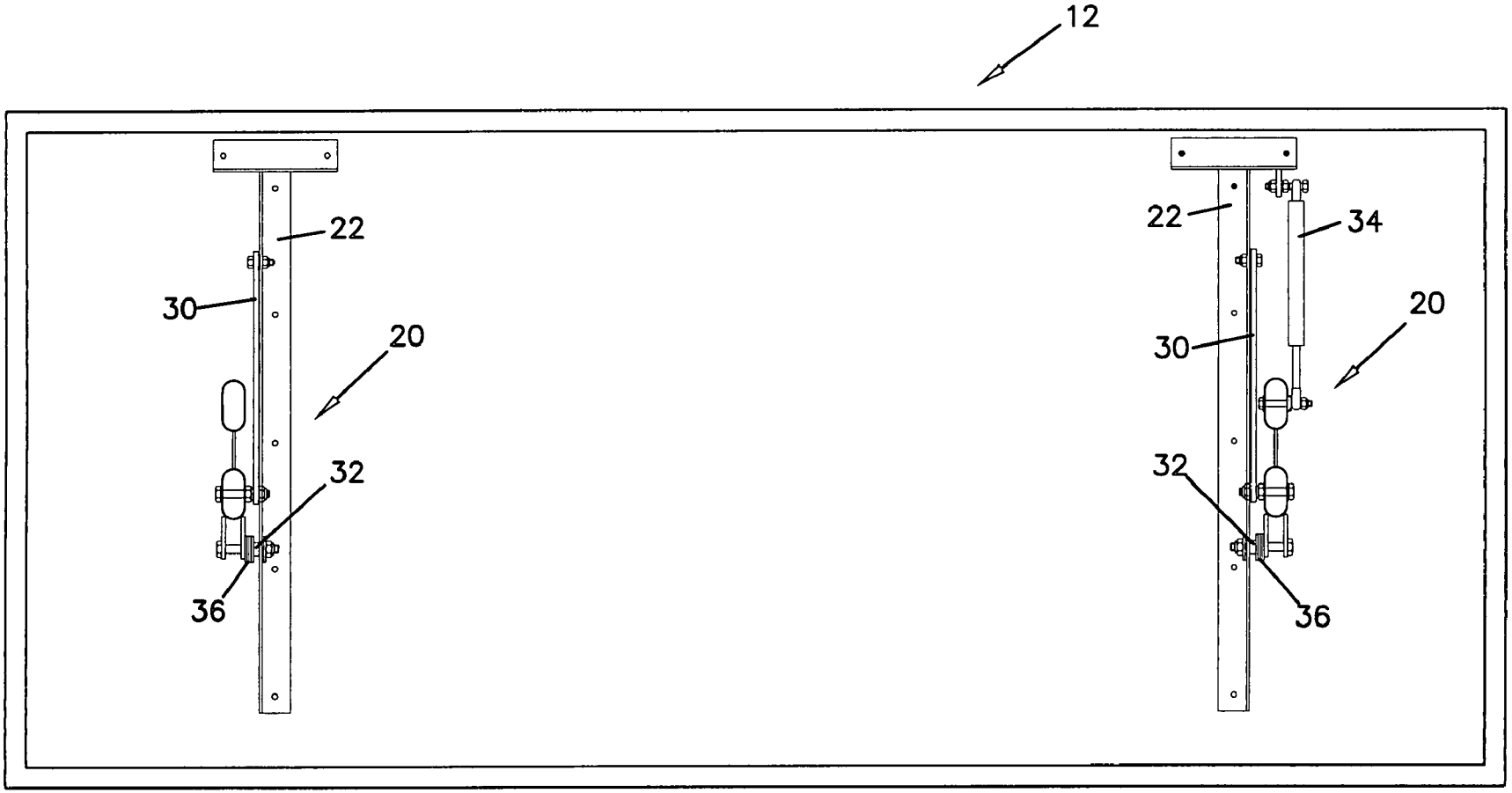
FIG. 5 is a bottom plan view of the table top and a portion of the folding linkage for the folding table shown in FIG. 1.
Figure 6:
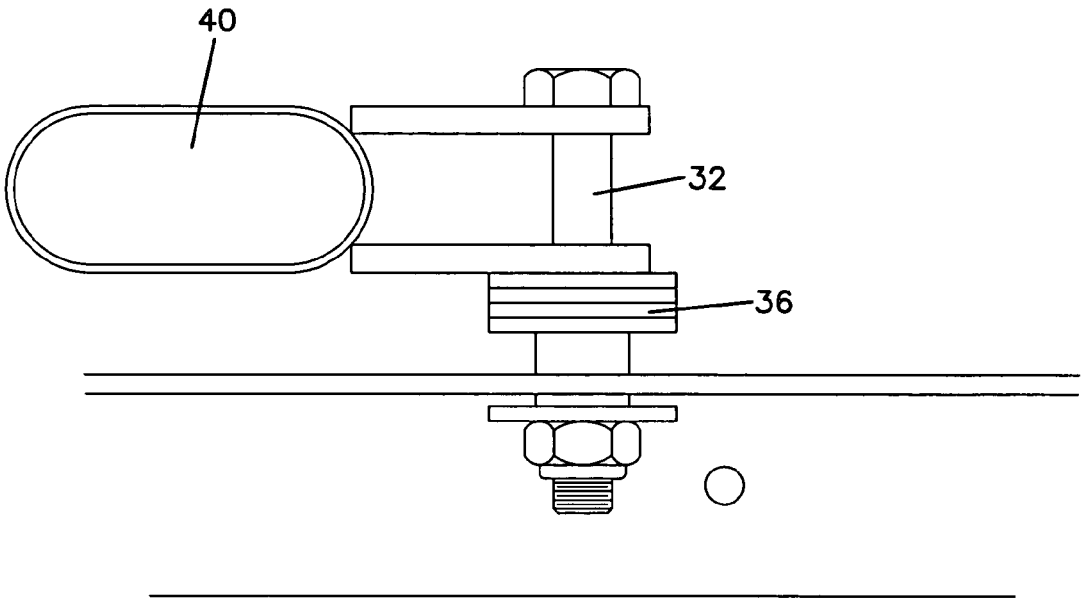
FIG. 6 is a detail view of a portion of the linkage for the folding table shown in FIG. 1.
Figure 7:
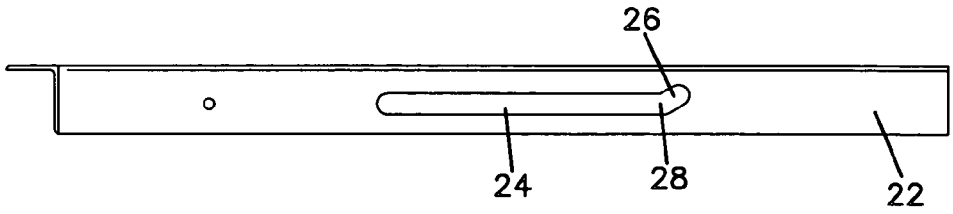
FIG. 7 is a detail view of a portion of the frame and the slot for the folding table shown in FIG. 1.

Each of the linkages 20 also includes an arm 30 mounted to the first linkage element 22 at the underside of the tabletop and to an upright member 40. The arm 30 provides guidance and support to the tabletop 12 during folding while the tabletop 12 pivots and slides on the follower 32. As the linkage 20 is safe and reliable and prevents accidental folding, a tabletop 12 weighing more than conventional tops may be utilized. A heavier tabletop 12, having a granite, marble or another designer finish, may weigh more and lead to folding at a faster than desired speed. Therefore, a damper 34, such as a gas spring or gas springs, may be added to one or both of the linkages 20 to control folding between the storage position and the use position. The use of a tabletop 12 having a heavier designer finish provides an improved appearance that may eliminate the need for tablecloths. This speeds setup and take down and saves laundering costs. During folding, the weight of the tabletop 12 causes the tabletop to pivot and slide on the slot 24, thereby lowering to the folded position on its own, as shown in FIG. 2. A stop 36, shown in FIGS. 5 and 6, is engaged by the arm 30 and prevents the tabletop 12 from folding too far and causing damage or leading to the table 10 inadvertently tipping over. In the embodiment shown, the bushing 36 surrounds the follower 32 and provides a larger diameter and protects the follower 32 from damage.

Actuation of the table 10 between the folded and unfolded positions is simple and safe according to the present invention. From the unfolded position as shown in FIGS. 2 and 4, the lower edge of the tabletop 12 is simply lifted upward. The lifting and folding motion causes the follower 32 to move along the slot 24 past the toggle point 28. The lifting and folding motion also moves the arm 30 from a substantially vertical position toward an inclined position extending outward from the frame uprights 40. The gas spring or springs 34 move toward a horizontal position and retract as the tabletop 12 is folded. The follower 32 moves along the slot 24 and passes into the end portion 26 until reaching the extremity of the end portion 26 of the slot 24. At this position, the tabletop is horizontal and the table 10 is configured for usage. As pressure applied downward to any of the edges does not fold the table 10, a weight placed on the tabletop 12 does not pose any accidental folding danger. The tabletop 12 is supported on the frame uprights 40 and held by the arm 30 and the follower 32 engaging the end of the slot. Accidental bumping cannot move the follower 32 sufficiently far along the end portion of the slot 26 to pass the toggle point 28.

To fold the table 10, the edge of the tabletop 12 opposite the end portion 26 is lifted upward pivoting and sliding on the followers 32. The top 12 must be lifted and folded until the follower 32 passes the toggle point 28. This occurs when the tabletop is lifted approximately 4 degrees. The folding motion is assisted by the damper 34 and guidance is also provided by the arm 30. Once the follower 30 passes the toggle point 28, the tabletop 12 will fold to the use position under its own weight. The top continues to fold until the arm 30 engages the stop or bushing 36 as shown in FIGS. 2 and 4. It can be appreciated that the angle, arc and length of the end portion 26 is important so that the follower 32 cannot be moved inadvertently to the straight portion of the slot 24. It can be appreciated that the angle of the end portion 26 cannot be too great and offer too much resistance as an operator may accidentally tip the table 10 over while lifting. Conversely, the length of the end portion 26 must not be too short and the angle too flat or the follower 32 may pass too easily past the toggle point 28. Testing provided an optimal angle of approximately 25 degrees between the end portion 26 and the main portion of the slot 24. The present invention provides a table and folding linkage that provides for safe, simple and reliable folding of the tabletop between the use and storage positions not possible with prior folding tables.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding table, comprising:

a frame having a riser portion fixed at a substantially vertical orientation when the table is configured in a use position and in a folded position;

a top mounted to the frame;

a linkage mounting to the frame and the top and facilitating movement of the top between a horizontal use position and a folded position wherein the top is substantially vertical, the linkage comprising:

a link mounted to the frame at a first end and to the table top at a second end;

a first element mounted to the top and defining a slot, the slot having a straight first portion having a first end and a second end, and an inclined second portion extending from the first end at an obtuse angle to the straight first portion; and a follower mounted at the top of the frame and slidably mounted in the slot and resting in the inclined second portion when the top is in the use position.

2. A table according to claim 1, further comprising a damper extending between the table top and the frame.

3. A table according to claim 2, wherein the damper comprises a gas spring.

4. A table according to claim 1, wherein the table top comprises a stone top.

5. A table according to claim 1, wherein the inclined second portion curves upward.

6. A table according to claim 1, wherein the inclined second portion is configured so that the follower cannot slide from the inclined second portion at the use position and wherein the follower passes into the straight first portion of the slot when the table top is lifted and folded.

7. A table according to claim 1, wherein the straight portion and the inclined second portion of the slot define a follower path extending along a general direction extending continuously between an extended end of the inclined second portion and an end of the straight first portion opposite the end portion.

8. A table according to claim 1, wherein the inclined second portion of the slot and downward force from the weight of the table top maintain the follower at an extended end of the inclined second portion when the table top is at a substantially horizontal position.

9. A table according to claim 1, wherein the frame includes a bottom cross member and a vertical table top support fixed to the bottom cross member, the vertical table top support extending vertically when the table top is in the use position and in the folded position.

10. A table according to claim 1, wherein the inclined second portion does not extend over the straight first portion.

11. A method of folding a folding table, the folding table having a frame with a follower and a table top having an element with a vertical wall mounted to an underside of the tabletop with a longitudinal slot formed in the vertical wall and having a main portion and an angled end portion extending upward at an obtuse angle to the main portion, the method comprising:

lifting only an edge of the table top opposite the slot end portion upward and continuously pivoting the table top toward a vertical position, to raise the end portion of the slot relative to the follower, to move the follower from its furthest position in the end portion continuously along the end portion and changing direction at an acute angle into the main portion;

allowing the table top to move toward a generally vertical position under its weight, wherein the follower moves along the main portion away from the angled end portion.

12. A method according to claim 11, further comprising:

unfolding the table by raising a lower edge of the table top at a folded generally vertical position, wherein the follower moves along the main portion of the longitudinal slot toward the angled end portion and automatically moves into the end portion as the table top is moved to a horizontal use position.

13. A method according to claim 11, wherein the main portion and the angled end portion form a toggle point and wherein the follower is moved past the toggle point as the table top is lifted and folded.

14. A method according to claim 11, wherein the angled end portion comprises an upward curving slot.

15. A method according to claim 11, wherein the follower moves continuously along a general direction extending toward an end of the main portion opposite the end portion.

16. A method according to claim 15, wherein the follower is moved solely by lifting an edge of the table opposite the end portion of the slot.

17. A linkage for a folding table having a frame and a folding table top, the linkage comprising:

a linkage configured for mounting to the frame proximate an upper end of a fixed vertical riser and to the top, and facilitating movement of the top between a horizontal use position and a folded position wherein the top is substantially vertical, the linkage comprising:

a link configured for mounting to the frame at a first end and to the table top at a second end;

a first element configured for mounting to the top and defining a slot, the slot having a first straight portion and a second inclined portion extending upward at an obtuse angle to the straight portion and generally away from the straight portion; and a follower configured for mounting at the top of the frame and slidably mounted in the slot and resting in the second inclined portion when the top is in the use position.

* * * * *